US008526870B2

(12) United States Patent
Shinshi

(10) Patent No.: US 8,526,870 B2
(45) Date of Patent: Sep. 3, 2013

(54) FIXING DEVICE AND IMAGE FORMING APPARATUS INCORPORATING SAME

(75) Inventor: Akira Shinshi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 338 days.

(21) Appl. No.: 12/963,120

(22) Filed: Dec. 8, 2010

(65) Prior Publication Data

US 2011/0200369 A1 Aug. 18, 2011

(30) Foreign Application Priority Data

Feb. 15, 2010 (JP) ..... 2010-029961

(51) Int. Cl.
*G03G 15/20* (2006.01)

(52) U.S. Cl.
USPC ..... 399/329; 399/328; 399/330

(58) Field of Classification Search
USPC ..... 399/328–330
See application file for complete search history.

(56) References Cited

U.S. PATENT DOCUMENTS

| | | | | |
|---|---|---|---|---|
| 5,182,606 | A * | 1/1993 | Yamamoto et al. | 399/335 |
| 6,384,378 | B2 * | 5/2002 | Natsuhara et al. | 219/216 |
| 7,021,753 | B2 * | 4/2006 | Sano et al. | 347/102 |
| 7,054,589 | B2 * | 5/2006 | Okayasu et al. | 399/329 |
| 7,206,541 | B2 * | 4/2007 | Fukita et al. | 399/328 |
| 7,406,287 | B2 * | 7/2008 | Matsumoto et al. | 399/328 |
| 2003/0156866 | A1 | 8/2003 | Shida et al. | |
| 2007/0048044 | A1 | 3/2007 | Tokuhiro et al. | |
| 2007/0292175 | A1 | 12/2007 | Shinshi | |
| 2008/0112739 | A1 | 5/2008 | Shinshi | |
| 2008/0175633 | A1 | 7/2008 | Shinshi | |
| 2008/0219730 | A1 | 9/2008 | Shinshi | |
| 2008/0298862 | A1 | 12/2008 | Shinshi | |
| 2009/0311016 | A1 | 12/2009 | Shinshi | |
| 2010/0092220 | A1 | 4/2010 | Hasegawa et al. | |

(Continued)

FOREIGN PATENT DOCUMENTS

| | | |
|---|---|---|
| EP | 1 927 902 A1 | 6/2008 |
| JP | 10-213984 | 8/1998 |

(Continued)

OTHER PUBLICATIONS

U.S. Appl. No. 12/828,612, filed Jul. 1, 2010, Masaharu Furuya, et al.

(Continued)

*Primary Examiner* — Walter L Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

A fixing device includes a fixing member, a heating member provided inside the fixing member to heat the fixing member, a nip formation member provided inside the fixing member and supported by the heating member, and a pressing member pressed against the nip formation member via the fixing member to form a fixing nip between the fixing member and the pressing member through which a recording medium bearing a toner image passes. The nip formation member includes a convex portion provided at a center of the nip formation member in an axial direction of the fixing member and protruding toward the heating member. The heating member has a tapered shape corresponding to the convex portion of the nip formation member, in which the heating member is tapered from lateral ends toward a center of the heating member in the axial direction of the fixing member.

7 Claims, 8 Drawing Sheets

(56) References Cited

U.S. PATENT DOCUMENTS

| | | | |
|---|---|---|---|
| 2010/0092221 | A1 | 4/2010 | Shinshi et al. |
| 2010/0202809 | A1 | 8/2010 | Shinshi et al. |
| 2010/0290822 | A1 | 11/2010 | Hasegawa et al. |

FOREIGN PATENT DOCUMENTS

| | | |
|---|---|---|
| JP | 2884714 | 2/1999 |
| JP | 3298354 | 4/2002 |
| JP | 2009-3410 | 1/2009 |

OTHER PUBLICATIONS

U.S. Appl. No. 12/841,593, filed Jul. 22, 2010, Masaaki Yoshikawa, et al.
U.S. Appl. No. 12/879,875, filed Sep. 10, 2010, Ippei Fujimoto, et al.
U.S. Appl. No. 12/852,079, filed Aug. 6, 2010, Akira Shinshi, et al.
U.S. Appl. No. 12/870,149, filed Aug. 27, 2010, Hirokatsu Suzuki, et al.
U.S. Appl. No. 12/888,980, filed Sep. 23, 2010, Yoshiki Yamaguchi, et al.
U.S. Appl. No. 12/923,231, filed Sep. 10, 2010.
U.S. Appl. No. 12/923,176, filed Sep. 8, 2010.
U.S. Appl. No. 12/874,734, filed Sep. 2, 2010, Akira Shinshi, et al.
U.S. Appl. No. 12/881,547, filed Sep. 14, 2010, Naoki Iwaya, et al.
U.S. Appl. No. 12/849,404, filed Aug. 3, 2010, Toshihiko Shimokawa, et al.
U.S. Appl. No. 12/878,480, filed Sep. 9, 2010, Yoshiki Yamaguchi, et al.
U.S. Appl. No. 12/880,327, filed Sep. 13, 2010, Ryota Yamashina, et al.
U.S. Appl. No. 12/857,953, filed Aug. 17, 2010, Masaaki Yoshikawa, et al.
U.S. Appl. No. 12/893,361, filed Sep. 29, 2010, Kenichi Hasegawa, et al.
U.S. Appl. No. 12/878,557, filed Sep. 9, 2010, Akira Shinshi, et al.
U.S. Appl. No. 12/946,276, filed Nov. 15, 2010, Yoshiki Yamaguchi, et al.
Extended European Search Report issued Sep. 15, 2011, in Patent Application No. 11150725.7.

* cited by examiner

FIXING DEVICE AND IMAGE FORMING APPARATUS INCORPORATING SAME

CROSS-REFERENCE TO RELATED APPLICATIONS

The present application is based on and claims priority to Japanese Patent Application No. 2010-029961, filed on Feb. 15, 2010, in the Japan Patent Office, which is hereby incorporated herein by reference in its entirety.

BACKGROUND OF THE INVENTION

1. Field of the Invention

Exemplary aspects of the present invention relate to a fixing device and an image forming apparatus, and more particularly, to a fixing device for fixing a toner image on a recording medium, and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may include a fixing belt or a fixing film to apply heat to the recording medium bearing the toner image. FIG. 1 is a sectional view of a fixing device 140R1 including a fixing belt 5. The fixing belt 5 is looped around a heating roller 2 and a fixing roller 3 in a state in which a tension roller 4 biases the fixing belt 5. A pressing roller 6R presses against the fixing roller 3 via the fixing belt 5 to form a fixing nip between the pressing roller 6R and the fixing belt 5. The fixing belt 5 is heated by a heater 1 provided inside the heating roller 2. As a recording medium 7 bearing a toner image passes between the fixing roller 3 and the pressing roller 6R on the fixing belt 5, the fixing belt 5 and the pressing roller 6R apply heat and pressure to the recording medium 7 bearing the toner image to fix the toner image on the recording medium 7.

One problem with such an arrangement, however, is that the heating roller 2 has a relatively large heat capacity, resulting in a longer warm-up time for the fixing device 140R1. To address this problem, instead of the fixing belt 5 the fixing device may include a fixing film having a relatively small heat capacity. FIG. 2 is a sectional view of a fixing device 140R2 including a fixing film 14. A ceramic heater 13 is provided inside a loop formed by the fixing film 14 and supported by a stay 12 via a holder 11. The pressing roller 6R presses against the ceramic heater 13 via the fixing film 14 to form a fixing nip between the pressing roller 6R and the fixing film 14. As a recording medium bearing a toner image passes between the pressing roller 6R and the fixing film 14, the fixing film 14 heated by the ceramic heater 13 and the pressing roller 6R apply heat and pressure to the recording medium bearing the toner image to fix the toner image on the recording medium.

However, the fixing film 14 also has a drawback in that, over time, friction between the ceramic heater 13 and the fixing film 14 sliding over the ceramic heater 13 increases, resulting eventually in unstable movement of the fixing film 14 and increasing the required driving torque of the fixing device 140R2.

To address the above-described problems, instead of the ceramic heater 13 the fixing device may include a hollow cylindrical heating member stationarily provided inside the loop formed by a fixing member (e.g., the fixing belt or the fixing film) across a clearance therebetween. A heater provided inside the hollow cylinder of the heating member heats the heating member, which in turn heats the fixing member, to maintain the fixing member at the proper temperature. The pressing roller is pressed against a nip formation member provided inside the loop formed by the fixing member via the fixing member to form the fixing nip between the fixing member and the pressing roller.

However, the heating member described above also has a drawback in that pressure applied by the pressing roller bends the nip formation member and the heating member supporting the nip formation member in such a manner that the nip formation member is sandwiched between the heating member and the fixing member. Specifically, the pressure applied by the pressing roller bends the center portion of the nip formation member in the longitudinal direction of the nip formation member parallel to the axial direction of the fixing member substantially. Accordingly, the heating member supporting the nip formation member is also bent. To address this problem, the center portion of the nip formation member in the longitudinal direction of the nip formation member may be given a convex shape protruding inward toward the heating member. However, when the pressing roller applies substantial pressure to the nip formation member having the convex center portion, the heating member contacted by the nip formation member is deformed like a bow along the convex shape of the nip formation member. Specifically, the center portion of the heating member in the axial direction of the fixing member, which is pressed by the convex center portion of the nip formation member, moves closer to the inner circumferential surface of the fixing member at the position diametrically opposite the fixing nip. By contrast, the lateral end portions of the heating member in the axial direction of the fixing member move away from the inner circumferential surface of the fixing member. In other words, the clearance provided between the fixing member and the heating member becomes excessively large at the lateral ends of the fixing member in the axial direction of the fixing member. Accordingly, heat is not transmitted from the heating member to the fixing member effectively at the lateral ends of the fixing member. As a result, the fixing member is not heated quickly, increasing the warm-up time of the fixing device.

BRIEF SUMMARY OF THE INVENTION

This specification describes below an improved fixing device. In one exemplary embodiment of the present invention, the fixing device, which fixes a toner image on a recording medium, includes a flexible endless belt-shaped fixing member, a heating member, a nip formation member, and a pressing member. The fixing member rotates in a predetermined direction of rotation and is formed into a loop. The heating member is provided inside the loop formed by the fixing member and faces an inner circumferential surface of the fixing member to heat the fixing member. The nip formation member is provided inside the loop formed by the fixing member and is supported by the heating member. The pressing member is pressed against the nip formation member via the fixing member to form a fixing nip between the fixing member and the pressing member through which the recording medium bearing the toner image passes. The nip formation member includes a central convex portion of increased thickness provided at a center of the nip formation member in an axial direction of the fixing member and protruding toward the heating member. The heating member has a tapered shape corresponding to the convex portion of the nip formation member, in which the heating member is tapered from lateral ends of increased diameter toward a center of reduced diameter of the heating member in the axial direction of the fixing member.

This specification further describes below an image forming apparatus. In one exemplary embodiment, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
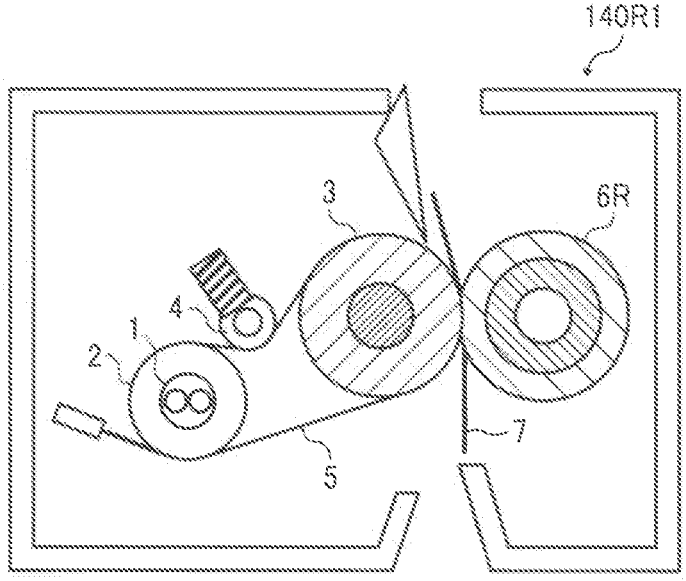
FIG. 1 RELATED ART
FIG. 1 is a sectional view of one related-art fixing device.
Figure 2:
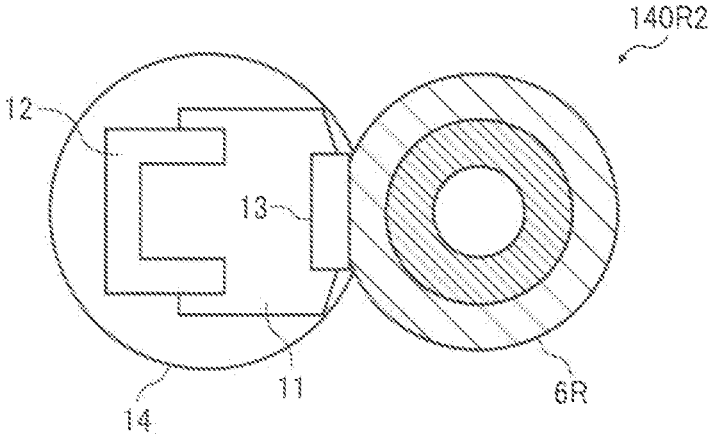
FIG. 2 RELATED ART
FIG. 2 is a sectional view of another related-art fixing device.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Figure 3:
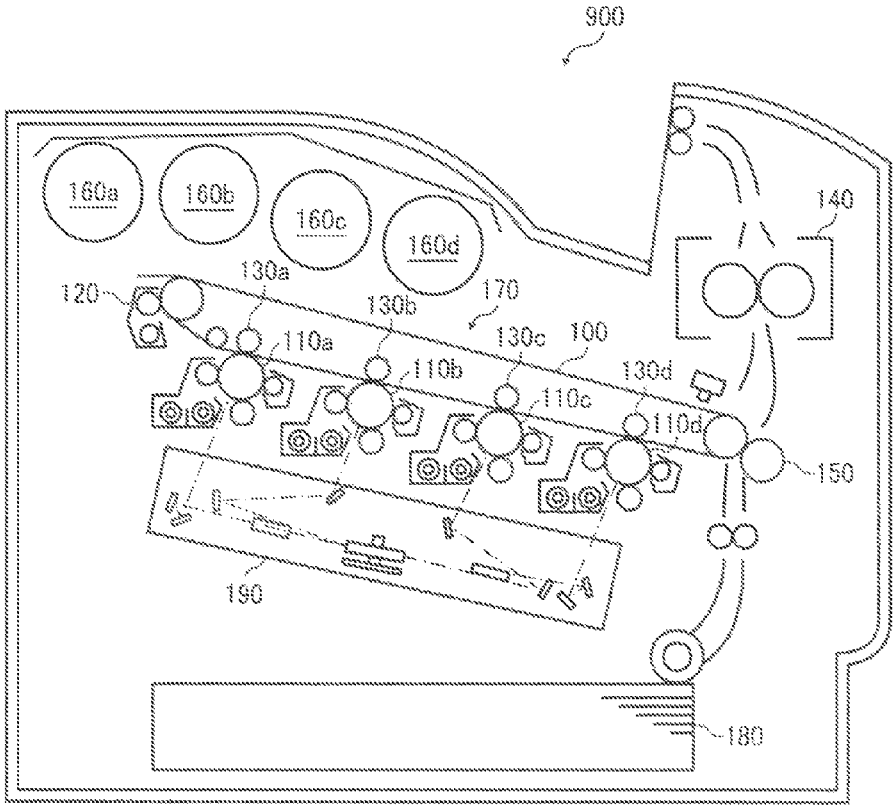
FIG. 3 is a schematic view of an image forming apparatus according to an exemplary embodiment of the present invention.

Referring now to the drawings, wherein like reference numerals designate identical or corresponding parts throughout the several views, in particular to FIG. 3, an image forming apparatus 900 according to an exemplary embodiment of the present invention is explained.

FIG. 3 is a schematic view of the image forming apparatus 900. As illustrated in FIG. 3, the image forming apparatus 900 may be a copier, a facsimile machine, a printer, a multifunction printer having at least one of copying, printing, scanning, plotter, and facsimile functions, or the like. According to this exemplary embodiment of the present invention, the image forming apparatus 900 is a tandem color printer for forming a color image on a recording medium by electrophotography or electrostatic recording.

As illustrated in FIG. 3, the image forming apparatus 900 includes an image forming device 170 provided in a center portion of the image forming apparatus 900, toner bottles 160*a*, 160*b*, 160*c*, and 160*d* provided above the image forming device 170, a writing unit 190 provided below the image forming device 170, a paper tray unit 180 provided below the writing unit 190 in a lower portion of the image forming apparatus 900, and a fixing device 140 provided above the image foaming device 170 in an upper portion of the image forming apparatus 900.

The image forming device 170 includes an intermediate transfer belt 100 formed into a loop, photoconductors 110*a*, 110*b*, 110*c*, and 110*d* disposed opposite the intermediate transfer belt 100, transfer rollers 130*a*, 130*b*, 130*c*, and 130*d* provided inside the loop formed by the intermediate transfer belt 100 and facing an inner circumferential surface of the intermediate transfer belt 100, a second transfer roller 150 provided outside the loop formed by the intermediate transfer belt 100 and facing an outer circumferential surface of the intermediate transfer belt 100, and a belt cleaning unit 120 provided outside the loop formed by the intermediate transfer belt 100 and facing the outer circumferential surface of the intermediate transfer belt 100.

The image forming apparatus 900 can have the known overall structure. For example, components provided in the image forming device 170 and used to form a toner image, such as chargers, an exposure device (e.g., the writing unit 190), development devices, and cleaners, surround the photoconductors 110*a*, 110*b*, 110*c*, and 110*d*, respectively.

Specifically, as illustrated in FIG. 3, the intermediate transfer belt 100 looped over a plurality of rollers is provided in substantially the center portion of the image forming apparatus 900 in such a manner that the intermediate transfer belt 100 is disposed diagonally down from left to right and is rotatable counterclockwise in FIG. 3.

The photoconductors 110*a*, 110*b*, 110*c*, and 110*d*, the chargers, the development devices, and the cleaners are integrated into process cartridges, respectively, which are arranged below the intermediate transfer belt 100 along the outer circumferential surface of the intermediate transfer belt 100 in such a manner that the photoconductors 110*a*, 110*b*, 110*c*, and 110*d* contact the lower outer circumferential surface of the intermediate transfer belt 100. The four process cartridges have an identical structure except that the process cartridges use toners in colors (e.g., yellow, cyan, magenta, and black) different from each other. Specifically, charging rollers serving as the chargers, development units serving as the development devices, and cleaning units serving as the cleaners surround the photoconductors 110*a*, 110*b*, 110*c*, and 110*d*, respectively. The four development units use the toners in colors different from each other. The toner bottles 160*a*, 160*b*, 160*c*, and 160*d* are provided above the intermediate transfer belt 100, and contain yellow, cyan, magenta, and black toners to be supplied to the development units through conveyance paths, respectively, in a predetermined amount.

The writing unit 190 is provided below the process cartridges, and is constructed of four light sources including laser diodes (LD) corresponding to yellow, cyan, magenta, and black image data sent from a client computer, for example; a polygon scanner including a hexagonal polygon mirror and a polygon motor; fθ lenses provided in optical paths of the respective light sources; lenses (e.g., long cylindrical lenses); mirrors; and the like. Laser beams emitted by the laser diodes according to the yellow, cyan, magenta, and black image data are deflected by the polygon scanner, and irradiate and scan the photoconductors 110*a*, 110*b*, 110*c*, and 110*d* to form electrostatic latent images on the photoconductors 110*a*, 110*b*, 110*c*, and 110*d*, respectively.

The transfer rollers 130*a*, 130*b*, 130*c*, and 130*d* are disposed opposite the photoconductors 110*a*, 110*b*, 110*c*, and 110*d* via the intermediate transfer belt 100, respectively, and are connected to a power source that applies a predetermined voltage to the transfer rollers 130*a*, 130*b*, 130*c*, and 130*d*. The transfer rollers 130*a*, 130*b*, 130*c*, and 130*d* primarily transfer yellow, cyan, magenta, and black toner images formed on the photoconductors 110*a*, 110*b*, 110*c*, and 110*d* by the development units that visualize the yellow, cyan, magenta, and black electrostatic latent images with the yellow, cyan, magenta, and black toners contained in the development units, respectively, onto the intermediate transfer belt 100 so that the yellow, cyan, magenta, and black toner images are superimposed on a same position on the intermediate transfer belt 100 to form a color toner image on the intermediate transfer belt 100.

The second transfer roller 150 is pressed against one of the plurality rollers supporting the intermediate transfer belt 100, that is, the rightmost roller in FIG. 3, via the intermediate transfer belt 100, and is connected to a power source that applies a predetermined voltage to the second transfer roller 150. The second transfer roller 150 pressed against the rightmost roller inside the loop formed by the intermediate transfer belt 100 contacts the intermediate transfer belt 100 to form a second transfer nip between the second transfer roller 150 and the intermediate transfer belt 100. Thus, when the second transfer roller 150 receives the predetermined voltage from the power source, the second transfer roller 150 secondarily transfers the color toner image formed on the intermediate transfer belt 100 onto a sheet serving as a recording medium conveyed from the paper tray unit 180 which is provided in the lower portion of the image forming apparatus 900 and contains sheets to be conveyed to the second transfer nip formed between the second transfer roller 150 and the intermediate transfer belt 100.

On the other hand, the belt cleaning unit 120 faces another one of the plurality of rollers supporting the intermediate transfer belt 100, that is, the leftmost roller in FIG. 3, via the intermediate transfer belt 100. The belt cleaning unit 120 cleans the outer circumferential surface of the intermediate transfer belt 100 after the color toner image formed on the intermediate transfer belt 100 is transferred onto the sheet.

The fixing device 140 is provided above the second transfer nip formed between the second transfer roller 150 and the intermediate transfer belt 100, and fixes the color toner image on the sheet sent from the second transfer nip semi-permanently.

Thereafter, the sheet bearing the fixed toner image is conveyed from the fixing device 140, and then discharged onto an output tray provided on top of the image forming apparatus 900.

Figure 4:
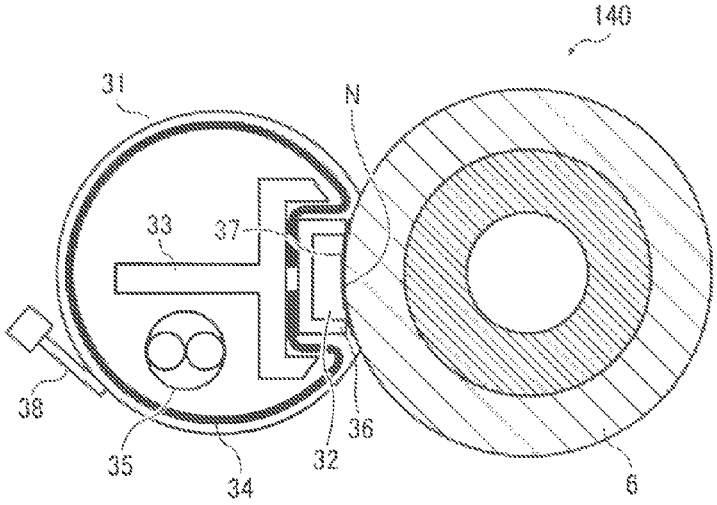
FIG. 4 is a vertical sectional view of a fixing device included in the image forming apparatus shown in FIG. 3.
Figure 5:
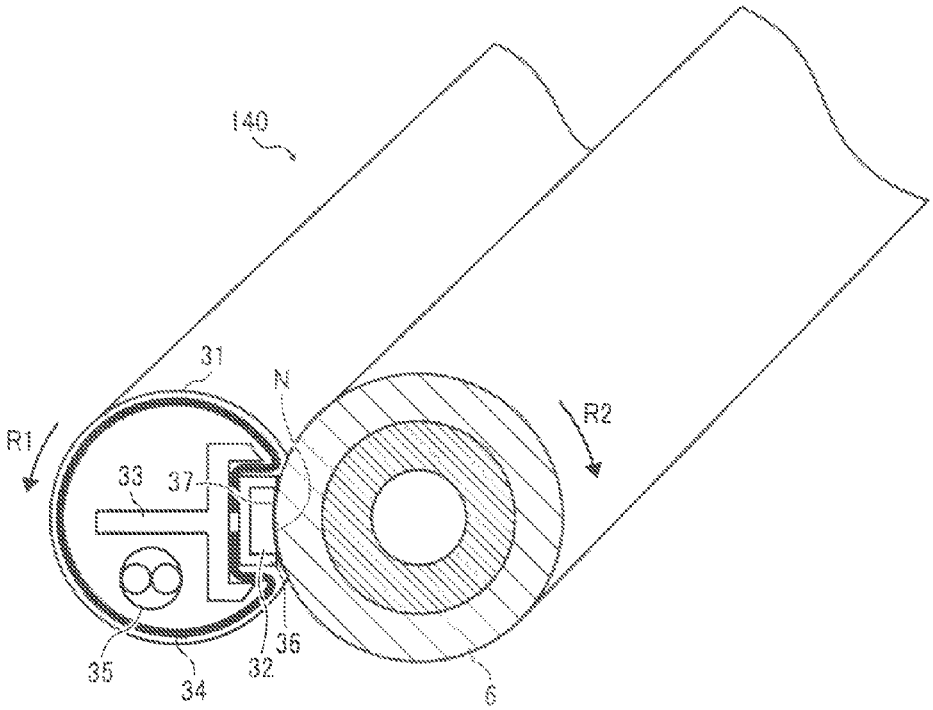
FIG. 5 is a perspective view of the fixing device shown in FIG. 4.
Figure 6:
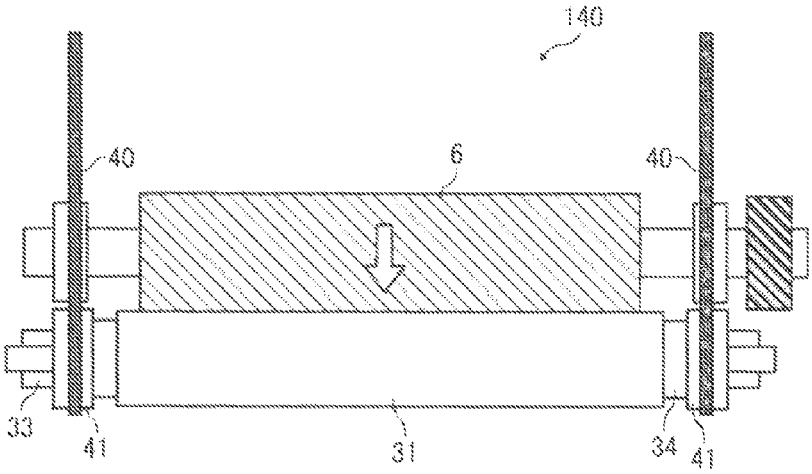
FIG. 6 is a side view of the fixing device shown in FIG. 5.

Referring to FIGS. 4 to 6, the following describes the fixing device 140. FIG. 4 is a vertical sectional view of the fixing device 140. FIG. 5 is a perspective view of the fixing device 140. FIG. 6 is a side view of the fixing device 140.

As illustrated in FIG. 4, the fixing device 140 includes a fixing belt 31 formed into a loop, a nip formation member 32, a support member 33, a metal pipe 34, a halogen heater 35, a heat insulator 36, and a lubrication sheet 37, which are provided inside the loop formed by the fixing belt 31, a thermistor 38 provided outside the loop formed by the fixing belt 31, and a pressing roller 6 disposed opposite the fixing belt 31.

The pressing roller 6 serving as a rotary pressing member or a pressing member is pressed against the nip formation member 32 via the fixing belt 31 serving as a fixing member. The metal pipe 34 formed into a substantially hollow cylinder is stationarily disposed close to an inner circumferential surface of the fixing belt 31 so that the inner circumferential surface of the fixing belt 31 slides over an outer circumferential surface of the metal pipe 34. For example, a gap not greater than 1 mm is provided between the inner circumferential surface of the fixing belt 31 and the outer circumferential surface of the metal pipe 34. The metal pipe 34 supports the nip formation member 32 via the heat insulator 36 that prevents heat transmission to the nip formation member 32, improving heating efficiency of the metal pipe 34 for heating the fixing belt 31. The support member 33 is stationarily disposed inside the hollow cylinder of the metal pipe 34, and supports a concave portion of the metal pipe 34, which houses and supports the nip formation member 32. A lubricant (e.g., silicon oil and fluorine grease) may be applied between the metal pipe 34 and the fixing belt 31 to decrease wear of the fixing belt 31 due to friction generated between the metal pipe 34 and the fixing belt 31 that slides over the metal pipe 34.

The metal pipe 34 is manufactured by bending a thin sheet of metal (hereinafter "sheet metal") such as aluminum, iron, or stainless steel into a generally cylindrical shape. According to this exemplary embodiment, the metal pipe 34 is made of SUS stainless steel. As illustrated in FIG. 6, the fixing device 140 further includes side plates 40 and flanges 41 attached to the side plates 40. Lateral ends of the metal pipe 34 in an axial direction of the metal pipe 34 are fixedly supported by the side plates 40 of the fixing device 140 via the flanges 41, respectively. As illustrated in FIG. 4, the metal pipe 34 has substantially a circular shape in cross-section. Alternatively, the metal pipe 34 may have an oval shape, a polygonal shape, or other shape in cross-section. It is to be noted that even if the metal pipe 34 has any of the circular, oval, polygonal, and other shapes in cross-section, the metal pipe 34 can have a cylindrical shape. Yet alternatively, a slit may be provided on a circumferential surface of the metal pipe 34. The mesh-like lubrication sheet 37 is provided between the nip formation member 32 and the fixing belt 31, but is not essential. The fixing belt 31 is heated directly by the metal pipe 34 and indirectly by the halogen heater 35 serving as a heat source or a heater provided inside the metal pipe 34 via the metal pipe 34. The thermistor 38 is used to adjust a temperature of the fixing belt 31. The heat source for heating the metal pipe 34 is not limited to the halogen heater 35, and therefore may be an induction heater, a resistant heat generator, a carbon heater, or the like.

As illustrated in FIGS. 4 and 5, the pressing roller 6 is pressed against the nip formation member 32 via the fixing belt 31 to form a concave fixing nip N between the pressing roller 6 and the fixing belt 31. Alternatively, the fixing nip N may have a planar shape or other shape. However, when the fixing nip N has the concave shape, a leading edge of a sheet discharged from the fixing nip N is directed to the pressing roller 6, thus facilitating separation of the sheet from the fixing belt 31 and thereby preventing jamming of the sheet at the fixing nip N.

The fixing belt 31 is a thin, flexible endless belt, and is constructed of a base layer, an elastic layer provided on the base layer, and a release layer provided on the elastic layer. The base layer is made of a metal material such as nickel and SUS stainless steel or a resin material such as polyimide. The elastic layer is made of silicon rubber. The release layer is made of tetrafluoroethylene perfluoroalkylvinylether copolymer (PFA) and/or polytetrafluoroethylene (PTFE). The fixing belt 31 has a thickness not greater than about 1 mm. Alternatively, the elastic layer may be omitted because the fixing belt 31 without the elastic layer has a smaller heat capacity that improves fixing property. However, when the fixing belt 31 and the pressing roller 6 apply pressure to a sheet bearing an unfixed toner image to fix the toner image on the sheet, slight surface asperities on a surface of the fixing belt 31 are transferred onto the toner image, roughening the solid toner image into an orange-peel image. To address this problem, the fixing belt 31 can preferably include the elastic layer made of silicon rubber which has a thickness not smaller than about 100 μm.

The pressing roller 6 is constructed of a hollow metal roll, a silicon rubber layer provided on the metal roll, and a release layer provided on the silicon rubber layer as a surface layer. Like the fixing belt 31, the pressing roller 6 includes the silicon rubber layer serving as an elastic layer. However, a thickness of the silicon rubber layer of the pressing roller 6 is different from the thickness of the elastic layer of the fixing belt 31. The release layer made of PFA or PTFE provides separation property for separating the sheet from the pressing roller 6. The pressing roller 6 receives a driving force transmitted from a driver (e.g., a motor) provided in the image forming apparatus 900 via a gear train, and is rotated by the driving force in a rotation direction R2. Consequently, the fixing belt 31 pressed by the pressing roller 6 at the fixing nip N rotates in a rotation direction R1 in accordance with rotation of the pressing roller 6. A spring presses the pressing roller 6 against the nip formation member 32 via the fixing belt 31 and deforms the silicon rubber layer of the pressing roller 6 to provide a predetermined nip length of the fixing nip N in a sheet conveyance direction.

Alternatively, the pressing roller 6 may be a solid roller. However, the hollow pressing roller 6 has a desired smaller heat capacity. Optionally, a heat source (e.g., a halogen heater) may be provided inside the hollow pressing roller 6. The silicon rubber layer of the pressing roller 6 can be made of solid rubber. Alternatively, when no heat source is provided inside the pressing roller 6, the pressing roller 6 may be made of sponge rubber. The pressing roller 6 made of sponge rubber can improve heat insulation to suppress heat transmission from the fixing belt 31 to the pressing roller 6.

A width of the support member 33, which is fixedly provided inside the metal pipe 34 to support the nip formation member 32, in a width direction, that is, a longitudinal direction, of the support member 33 parallel to an axial direction of the fixing belt 31 is equivalent to at least a width of the nip formation member 32 and the metal pipe 34 in a width direction, that is, a longitudinal direction, of the nip formation member 32 and the metal pipe 34 parallel to the axial direction of the fixing belt 31. Lateral ends of the support member 33 in the width direction of the support member 33 are fixedly supported by the side plates 40 of the fixing device 140, respectively. A surface of the support member 33 is insulated or mirror-finished so that the support member 33 is not heated by the halogen heater 35, thus reducing wasteful energy consumption and utilizing radiation heat generated by the halogen heater 35 to heat the metal pipe 34.

As illustrated in FIG. 5, when the pressing roller 6 presses the fixing belt 31 against the nip formation member 32, pressure applied by the pressing roller 6 bends the support member 33 and the nip formation member 32 supported by the support member 33. Specifically, the nip formation member 32 and the support member 33 are bent substantially at a center of the fixing belt 31 in the axial direction of the fixing belt 31. Accordingly, a predetermined nip width of the fixing nip N formed between the fixing belt 31 and the pressing roller 6 is not provided.

Figure 7A:
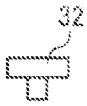
FIG. 7A is a sectional view of a nip formation member included in the fixing device shown in FIG. 4.
Figure 7B:
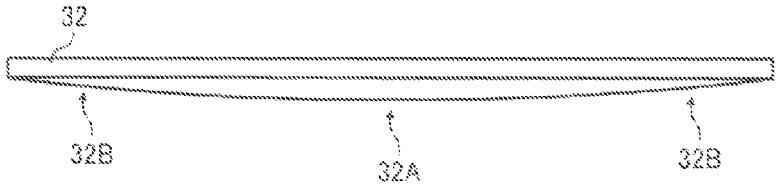
FIG. 7B is a side view of the nip formation member shown in FIG. 7A.

To address this problem, the nip formation member 32 includes a central convex portion 32A at a center of the nip formation member 32 in the longitudinal direction of the nip formation member 32 parallel to the axial direction of the fixing belt 31 as illustrated in FIG. 7B. The central convex portion 32A protrudes toward the metal pipe 34 depicted in FIG. 4 with respect to lateral end portions 32B of the nip formation member 32 provided at lateral ends of the nip formation member 32 in the longitudinal direction of the nip formation member 32 so as to provide the predetermined nip width of the fixing nip N also at the center of the fixing belt 31.

Referring to FIGS. 7A, 7B, 8A, 8B, 9A, and 9B, the following describes the nip formation member 32 having the central convex portion 32A. FIG. 7A is a sectional view of the nip formation member 32. FIG. 7B is a side view of the nip formation member 32. As illustrated in FIG. 7B, the central convex portion 32A of the nip formation member 32 has a height sufficient to offset bending of the nip formation member 32 due to pressure applied by the pressing roller 6. Accordingly, even when the support member 33 is bent by pressure applied by the pressing roller 6, a surface of the nip formation member 32 facing the fixing nip N is flattened, providing the predetermined nip width of the fixing nip N.

Figure 8A:
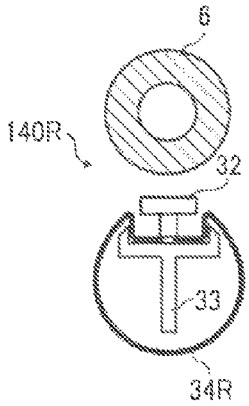
FIG. 8A is a sectional view of a comparative fixing device.
Figure 8B:
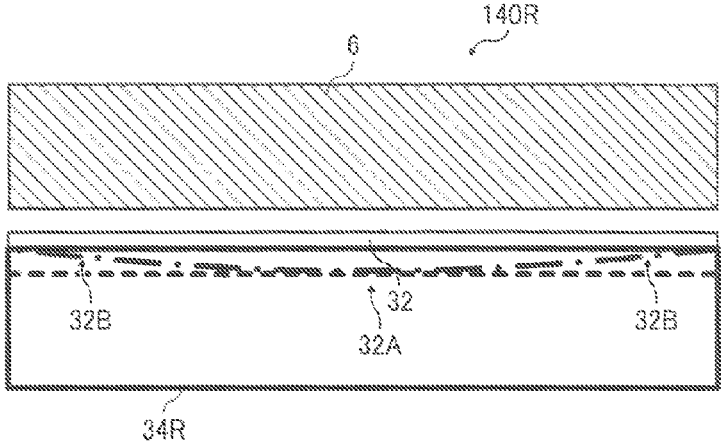
FIG. 8B is a plan view of the comparative fixing device shown in FIG. 8A.
Figure 9A:
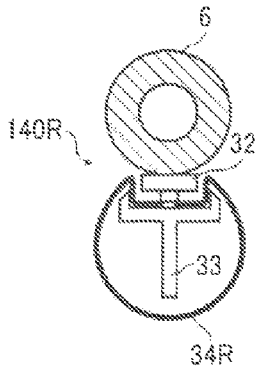
FIG. 9A is a sectional view of the comparative fixing device shown in FIG. 8A when a pressing roller is pressed against a nip formation member.
Figure 9B:
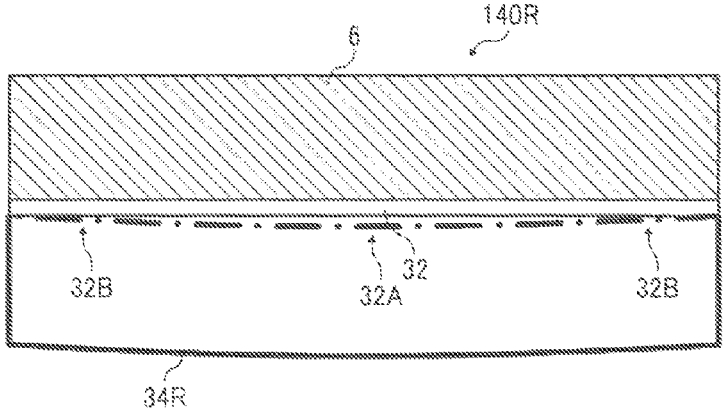
FIG. 9B is a plan view of the comparative fixing device shown in FIG. 9A.

FIG. 8A is a sectional view of a comparative fixing device 140R when the pressing roller 6 is not pressed against the nip formation member 32. FIG. 8B is a plan view of the pressing roller 6, the nip formation member 32, and a comparative metal pipe 34R when the pressing roller 6 is not pressed against the nip formation member 32. FIG. 9A is a sectional view of the comparative fixing device 140R when the pressing roller 6 is pressed against the nip formation member 32. FIG. 9B is a plan view of the pressing roller 6, the nip formation member 32, and the comparative metal pipe 34R when the pressing roller 6 is pressed against the nip formation member 32.

As illustrated in FIGS. 8B and 9B, the nip formation member 32 includes the rib-shaped central convex portion 32A at the center of the nip formation member 32 in the longitudinal direction of the nip formation member 32. When the pressing roller 6 is not pressed against the nip formation member 32 as illustrated in FIG. 8A, the lateral end portions 32B of the nip formation member 32 provided at the lateral ends of the nip formation member 32 in the longitudinal direction of the nip formation member 32 are slightly separated from the comparative metal pipe 34R serving as a heating member as illustrated in FIG. 8B. By contrast, when the pressing roller 6 is pressed against the nip formation member 32 as illustrated in FIG. 9A, the nip formation member 32 and the support member 33 are bent by pressure applied by the pressing roller 6 in a state in which the surface of the nip formation member 32 facing the fixing nip N is planar as illustrated in FIG. 9B. Accordingly, the predetermined nip width is provided both at the center and the lateral ends of the nip formation member 32 in the longitudinal direction of the nip formation member 32 parallel to the axial direction of the fixing belt 31. Consequently, the comparative fixing device 140R provides proper fixing property at a predetermined temperature.

Figure 10:
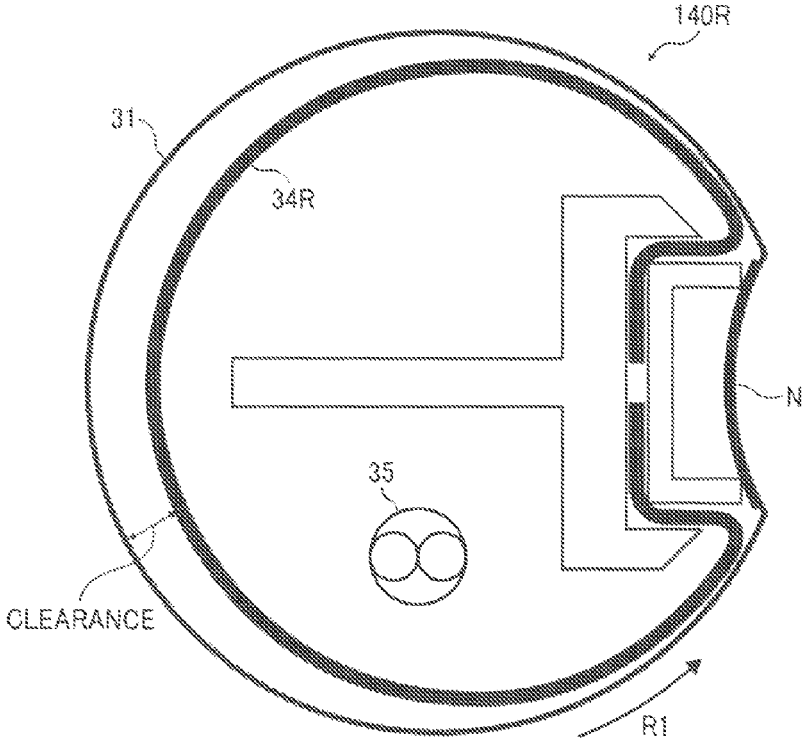
FIG. 10 is a partially enlarged sectional view of the comparative fixing device shown in FIG. 9A at a lateral end of a fixing belt included in the comparative fixing device in an axial direction of the fixing belt.

However, a substantial clearance may arise between an outer circumferential surface of the comparative metal pipe 34R and the inner circumferential surface of the fixing belt 31, which adversely increases toward lateral ends of the fixing belt 31 in the axial direction of the fixing belt 31. FIG. 10 is a partially enlarged sectional view of the comparative fixing device 140R at the lateral end of the fixing belt 31 in the axial direction of the fixing belt 31. The halogen heater 35 provided inside the comparative metal pipe 34R heats the comparative metal pipe 34R, and then heat is transmitted from the comparative metal pipe 34R to the fixing belt 31 to heat the fixing belt 31. With this configuration, if the clearance between the outer circumferential surface of the comparative metal pipe 34R and the inner circumferential surface of the fixing belt 31 is too large, heat is not transmitted from the comparative metal pipe 34R to the fixing belt 31 effectively. Accordingly, the fixing belt 31 is not heated to a proper fixing temperature quickly, resulting in faulty fixing at the lateral ends of the fixing belt 31 in the axial direction of the fixing belt 31.

Figure 11A:
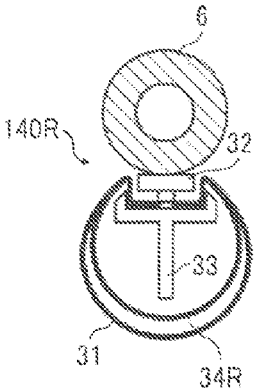
FIG. 11A is a sectional view of the comparative fixing device shown in FIG. 10 at the lateral end of the fixing belt in the axial direction of the fixing belt.
Figure 11B:
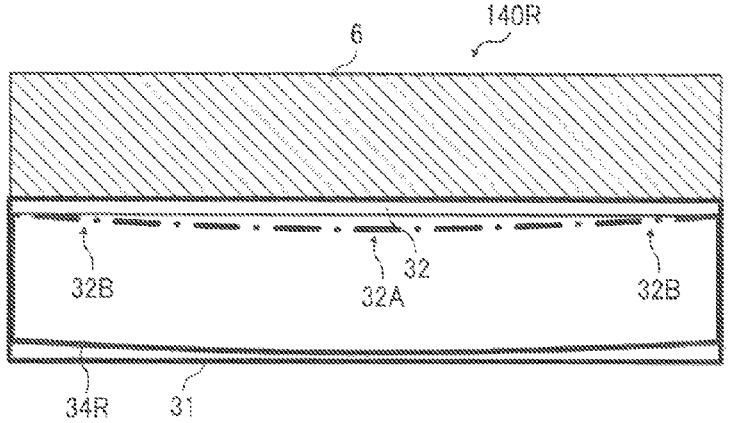
FIG. 11B is a plan view of the comparative fixing device shown in FIG. 11A.

Referring to FIGS. 11A and 11B, the following describes the mechanism that generates the substantial clearance between the fixing belt 31 and the comparative metal pipe 34R at the lateral ends of the fixing belt 31 in the axial direction of the fixing belt 31. FIG. 11A is a sectional view of the comparative fixing device 140R at the lateral end of the fixing belt 31 in the axial direction of the fixing belt 31. FIG. 11B is a plan view of the pressing roller 6, the fixing belt 31, the nip formation member 32, and the comparative metal pipe 34R.

The nip formation member 32 has the central convex portion 32A in the longitudinal direction of the nip formation member 32, so that the surface of the nip formation member 32 facing the fixing nip N is flattened when the pressing roller 6 is pressed against the nip formation member 32 via the fixing belt 31. When the pressing roller 6 applies pressure to the nip formation member 32, the support member 33 and the nip formation member 32 supported by the support member 33 are deformed or bent. Consequently, the comparative metal pipe 34R provided between the support member 33 and the nip formation member 32 is also bent in accordance with bending of the nip formation member 32 and the support member 33. FIG. 11B illustrates the bent comparative metal pipe 34R in the axial direction of the fixing belt 31.

On the other hand, the fixing belt 31 has an identical circumferential length both at a center portion and lateral end portions of the fixing belt 31 in the axial direction of the fixing belt 31. Accordingly, the clearance between the comparative metal pipe 34R and the fixing belt 31 is appropriate at the center of the fixing belt 31 in the axial direction of the fixing belt 31 at which the comparative metal pipe 34R is bent. By contrast, the clearance between the comparative metal pipe 34R and the fixing belt 31 is too large at the lateral ends of the fixing belt 31 in the axial direction of the fixing belt 31 at a position farthest from the fixing nip N in the rotation direction R1 of the fixing belt 31 as illustrated in FIG. 10. Consequently, heat is not transmitted from the comparative metal pipe 34R to the fixing belt 31 quickly.

A lubricant (e.g., grease) is applied between the outer circumferential surface of the comparative metal pipe 34R and the inner circumferential surface of the fixing belt 31 to cause the fixing belt 31 to rotate and slide over the outer circumferential surface of the comparative metal pipe 34R smoothly. When the comparative metal pipe 34R is disposed close to the fixing belt 31 only at the center portion of the fixing belt 31 in the axial direction of the fixing belt 31, the lubricant is accumulated at the lateral end portions of the fixing belt 31 in the axial direction of the fixing belt 31. To address this problem, in the comparative fixing device 140R, the clearance between the comparative metal pipe 34R and the fixing belt 31 is small, and the lubricant applied between the comparative metal pipe 34R and the fixing belt 31 is circulated through the clearance in a circumferential direction of the fixing belt 31 to prevent wear of the nip formation member 32 due to friction generated between the fixing belt 31 and the nip formation member 32 and decrease load applied to the rotating fixing belt 31.

However, when the substantial clearance is provided between the comparative metal pipe 34R and the fixing belt 31 as illustrated in FIG. 10, the lubricant is not circulated through the clearance by rotation of the fixing belt 31 due to viscosity of the lubricant. Accordingly, the lubricant is accumulated in the clearance between the comparative metal pipe 34R and the fixing belt 31. Thus, the blocked circulation of the lubricant accelerates wear of the nip formation member 32, degrading durability of the comparative fixing device 140R. Moreover, the lubricant applied in the clearance between the comparative metal pipe 34R and the fixing belt 31 at the center portion of the fixing belt 31 in the axial direction of the fixing belt 31 is pushed toward the lateral end portions of the fixing belt 31 in the axial direction of the fixing belt 31 at which the larger clearance is provided between the comparative metal pipe 34R and the fixing belt 31. Accordingly, the lubricant leaks from the lateral end portions of the fixing belt 31 in the axial direction of the fixing belt 31.

Figure 12A:
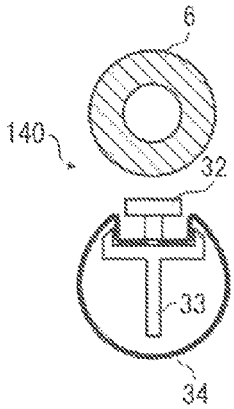
FIG. 12A is a sectional view of the fixing device shown in FIG. 5 when a pressing roller is not pressed against a nip formation member.
Figure 12B:
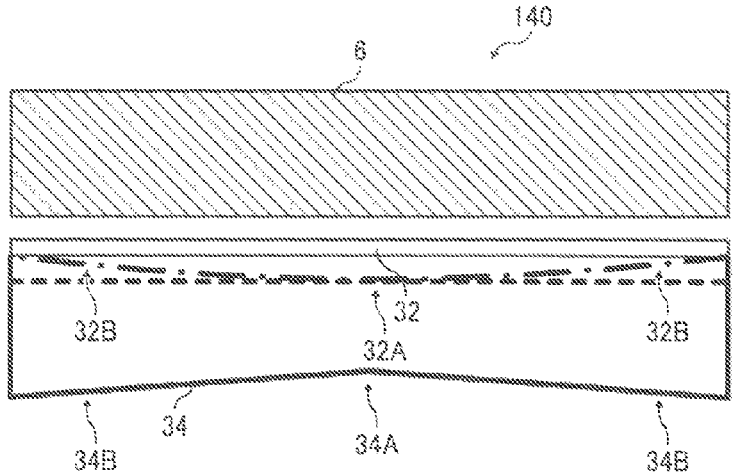
FIG. 12B is a plan view of the fixing device shown in FIG. 12A.
Figure 13A:
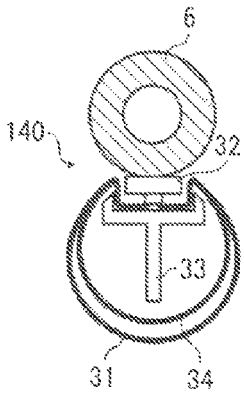
FIG. 13A is a sectional view of the fixing device shown in FIG. 12A when the pressing roller is pressed against the nip formation member.
Figure 13B:
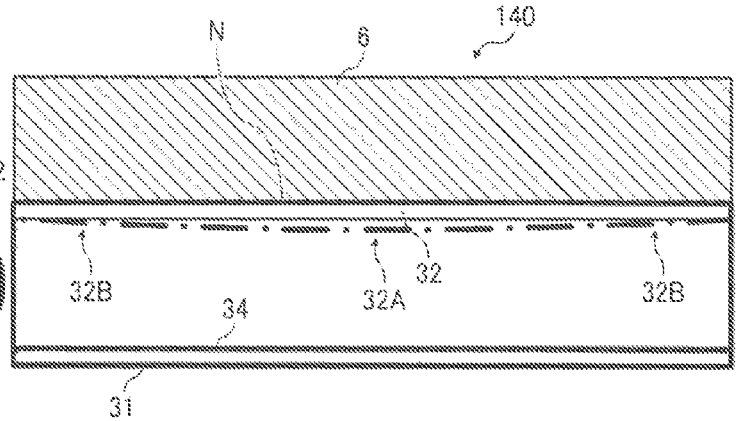
FIG. 13B is a plan view of the fixing device shown in FIG. 13A.

To address the above-described problems, the fixing device 140 according to this exemplary embodiment has the configuration described below. FIG. 12A is a sectional view of the fixing device 140 when the pressing roller 6 is not pressed against the nip formation member 32. FIG. 12B is a plan view of the pressing roller 6, the nip formation member 32, and the metal pipe 34 when the pressing roller 6 is not pressed against the nip formation member 32. FIG. 13A is a sectional view of the fixing device 140 when the pressing roller 6 is pressed against the nip formation member 32. FIG. 13B is a plan view of the pressing roller 6, the fixing belt 31, the nip formation member 32, and the metal pipe 34 when the pressing roller 6 is pressed against the nip formation member 32. In FIGS. 12A and 12B, the fixing belt 31, the halogen heater 35, the heat insulator 36, the lubrication sheet 37, and the thermistor 38 depicted in FIG. 4 are omitted. In FIGS. 13A and 13B, the halogen heater 35, the heat insulator 36, the lubrication sheet 37, and the thermistor 38 depicted in FIG. 4 are omitted.

The metal pipe 34 has a thickness in a range of from about 0.1 mm to about 0.2 mm. The clearance between the outer circumferential surface of the metal pipe 34 and the inner circumferential surface of the fixing belt 31 is about 0.5 mm at maximum. According to this exemplary embodiment, an inner diameter of the fixing belt 31 is about 30 mm. The nip formation member 32 has a convex shape in which the central concave portion 32A of the rib of the nip formation member 32 in the longitudinal direction of the nip formation member 32 parallel to the axial direction of the fixing belt 31 protrudes toward the metal pipe 34 by about 0.6 mm compared to the lateral end portions 32B of the rib of the nip formation member 32 in the longitudinal direction of the nip formation member 32. Thus, when the pressing roller 6 presses the fixing belt 31 against the nip formation member 32 as illustrated in FIG. 13A, the nip formation member 32 forms the planar fixing nip N between the pressing roller 6 and the fixing belt 31, as illustrated in FIG. 13B.

When the pressing roller 6 applies pressure to the nip formation member 32 having the above-described structure, the clearance of about 0.5 mm is provided between the outer circumferential surface of the metal pipe 34 and the inner circumferential surface of the fixing belt 31 at the center portion of the fixing belt 31 in the axial direction of the fixing belt 31. With a conventional, straight metal pipe having a uniform diameter, the clearance between the straight metal pipe and the fixing belt 31 is enlarged to about 1.1 mm at the lateral end portions of the fixing belt 31 in the axial direction of the fixing belt 31. Accordingly, the fixing belt 31 is not heated by the straight metal pipe sufficiently. To address this problem, in the fixing device 140 according to this exemplary embodiment, lateral end portions 34B of the metal pipe 34 in cross-section in the longitudinal direction of the metal pipe 34 parallel to the axial direction of the fixing belt 31 are greater than a center portion 34A of the metal pipe 34 in cross-section in the longitudinal direction of the metal pipe 34, as illustrated in FIG. 12B. In other words, a diameter of the metal pipe 34 increases from the center portion 34A toward the lateral end portions 34B of the metal pipe 34 in the longitudinal direction of the metal pipe 34. For example, a diameter of the lateral end portions 34B of the metal pipe 34 in the longitudinal direction of the metal pipe 34 is greater than a diameter of the center portion 34A of the metal pipe 34 in the longitudinal direction of the metal pipe 34 by about 0.6 mm. In other words, the difference between the diameter of the lateral end portions 34B and the diameter of the center portion 34A in the longitudinal direction of the metal pipe 34 corresponds to the height of the convex portion 32A of the nip formation member 32, which is sufficient to offset bending of the nip formation member 32 caused by pressure applied by the pressing roller 6 to the nip formation member 32 so as to provide substantially uniform clearance between the inner circumferential surface of the fixing belt 31 and the outer circumferential surface of the metal pipe 34 in the axial direction of the fixing belt 31. Accordingly, when the pressing roller 6 presses the fixing belt 31 against the nip formation member 32, the clearance between the metal pipe 34 and the fixing belt 31 at the lateral end portions 34B of the metal pipe 34 in the axial direction of the fixing belt 31 is decreased by about 0.6 mm. Consequently, the clearance between the metal pipe 34 and the fixing belt 31 at the center portion 34A of the metal pipe 34 in the axial direction of the fixing belt 31 is equivalent to the clearance between the metal pipe 34 and the fixing belt 31 at the lateral end portions 34B of the metal pipe 34 in the axial direction of the fixing belt 31.

In order to provide the increased outer diameter of the lateral end portions 34B of the metal pipe 34 in the longitudinal direction of the metal pipe 34 in a state in which the metal pipe 34 is assembled into the fixing device 140, the metal pipe 34 can be tapered. However, the metal pipe 34 serving as a heating member is formed of sheet metal having a thickness of about 0.1 mm. Accordingly, spring-back generated by the sheet metal processed into the metal pipe 34 may prevent the metal pipe 34 from being tapered precisely. Further, an amount of spring-back generated by the metal pipe 34 may fluctuate. Accordingly, increased precision in processing the sheet metal into the tapered metal pipe 34 may decrease production yields of the metal pipe 34, resulting in increased manufacturing costs.

Figure 14A:
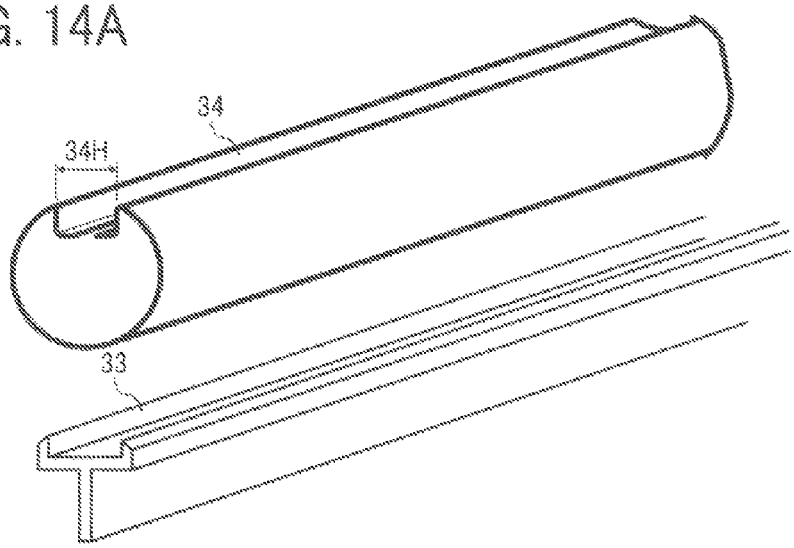
FIG. 14A is a perspective view of a metal pipe and a support member included in the fixing device shown in FIG. 12A before being assembled.
Figure 14B:
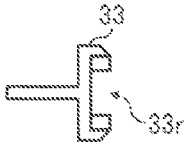
FIG. 14B is a sectional view of the support member shown in FIG. 14A.
Figure 14C:
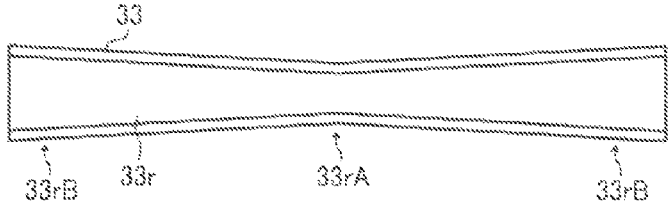
FIG. 14C is a plan view of the support member shown in FIG. 14B.
Figure 14D:
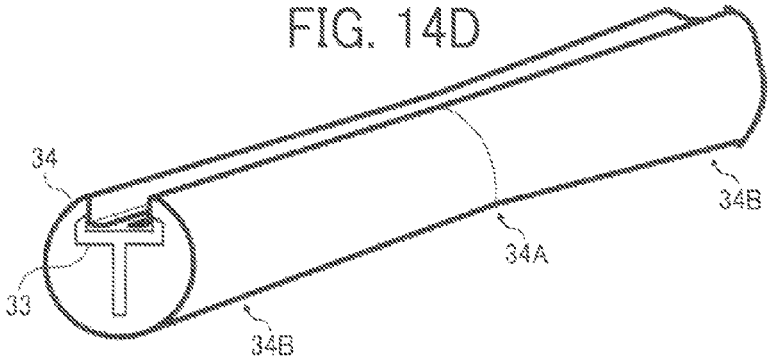
FIG. 14D is a perspective view of the metal pipe and the support member shown in FIG. 14A after being assembled.

To address this problem, another method for manufacturing the metal pipe 34 uses a conventional, straight cylindrical metal pipe without a tapered shape, which is manufactured by bending a flat thin plate into a cylinder. Referring to FIGS. 14A, 14B, 14C, and 14D, the following describes the manufacturing method using the conventional, straight cylindrical metal pipe. FIG. 14A is a perspective view of the metal pipe 34 and the support member 33 before being assembled. FIG. 14B is a sectional view of the support member 33. FIG. 14C is a plan view of the support member 33. FIG. 14D is a perspective view of the metal pipe 34 and the support member 33 after being assembled.

As illustrated in FIG. 14A, the metal pipe 34 includes a concave portion 34H. The metal pipe 34 is elastically deformed in such a manner that the concave portion 34H of the metal pipe 34, which houses the nip formation member 32 depicted in FIG. 5, is widened toward the lateral end portions 34B (depicted in FIG. 12B) of the metal pipe 34 in the longitudinal direction of the metal pipe 34 parallel to the axial direction of the fixing belt 31. Accordingly, the metal pipe 34 is tapered. Specifically, when the metal pipe 34 is bent into a cylinder, the metal pipe 34 generates an elastic force in a direction in which the bent metal pipe 34 returns to its original flat shape. The metal pipe 34 is tapered by using such elastic force.

For example, as illustrated in FIG. 14C, the support member 33 includes a groove 33*r* provided in the support member 33 in such a manner that the groove 33*r* is tapered in the longitudinal direction of the support member 33 parallel to the axial direction of the fixing belt 31 depicted in FIG. 5. Specifically, the groove 33*r* includes a center portion 33*r*A provided at a center of the groove 33*r* in a longitudinal direction of the groove 33*r* parallel to the axial direction of the fixing belt 31 of reduced diameter, and lateral end portions 33*r*B provided at lateral ends of the groove 33*r* in the longitudinal direction of the groove 33*r* of increased diameter compared to the diameter of the center portion 33*r*A. In other words, the diameter of the groove 33*r* becomes greater from the center portion 33*r*A toward the lateral end portions 33*r*B thereof. The concave portion 34H of the metal pipe 34 is placed in the groove 33*r* of the support member 33, and is adhered to interior walls of the groove 33*r* with screws or the like. Thus, the metal pipe 34 is tapered.

Figure 15:
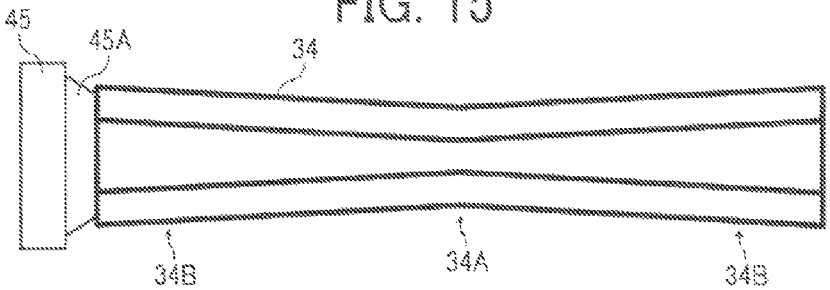
FIG. 15 is a side view of the metal pipe shown in FIG. 14A and a flange attached to the metal pipe.

Referring to FIG. 15, the following describes yet another method for manufacturing the metal pipe 34. FIG. 15 is a side view of the metal pipe 34 and a flange 45 attached to the metal pipe 34 and including a tapered portion 45A.

The tapered portion 45A of the flange 45 is inserted into the metal pipe 34 at the lateral end portion 34B of the metal pipe 34 in the longitudinal direction of the metal pipe 34 parallel to the axial direction of the fixing belt 31, so as to arbitrarily adjust an amount of tapering of the metal pipe 34. Specifically, the amount of tapering of the metal pipe 34 is changed by adjusting a depth of insertion of the tapered portion 45A of the flange 45 into the metal pipe 34. In other words, the outer diameter of the lateral end portion 34B of the metal pipe 34 in the longitudinal direction of the metal pipe 34 is enlarged by adjusting the depth of insertion of the tapered portion 45A of the flange 45 into the metal pipe 34. In FIG. 15, the flange 45 is shrunk to simplify the drawing. However, the flange 45 has a proper length in the longitudinal direction of the metal pipe 34 with respect to a length of the metal pipe 34 in the longitudinal direction of the metal pipe 34 to provide a predetermined width of the fixing nip N formed between the fixing belt 31 and the pressing roller 6 when the pressing roller 6 presses the fixing belt 31 against the nip formation member 32 as illustrated in FIG. 4.

Referring to FIG. 5, the following describes effects provided by the fixing device 140. With the configuration described above, particularly, with the tapered metal pipe 34 corresponding to the nip formation member 32 having the convex portion 32A, the clearance between the inner circumferential surface of the fixing belt 31, that is, an endless belt serving as a fixing member, and the outer circumferential surface of the metal pipe 34 serving as a cylindrical heating member does not increase toward the lateral end portions of the fixing member in the axial direction of the fixing member, preventing faulty fixing due to inefficient heat transmission from the heating member to the fixing member. The clearance between the fixing member and the heating member provides effect of resistance against heat transmission from the heating member to the fixing member. Further, the pressing roller 6 serving as a pressing member is pressed against the nip formation member 32 serving as a nip formation member to form the fixing nip N between the pressing member and the nip formation member via the fixing member. Even when pressure applied by the pressing member deforms the nip formation member, the clearance between the fixing member and the heating member at the lateral end portions of the fixing member in the axial direction of the fixing member does not become excessively greater than the clearance between the fixing member and the heating member at the center portion of the fixing member in the axial direction of the fixing member in accordance with the deformation of the nip formation member. Accordingly, heat is transmitted from the heating member to the fixing member effectively, providing desired fixing property.

Further, heat transmission efficiency at the center portion of the fixing member in the axial direction of the fixing member is equivalent to heat transmission efficiency at the lateral end portions of the fixing member in the axial direction of the fixing member, preventing variation of heat distribution of the fixing member.

When a lubricant is applied to the clearance between the fixing member and heating member, the lubricant is spread and circulated through the clearance. Accordingly, rotation of the fixing member constantly supplies the lubricant to the nip formation member, improving durability of the nip formation member and suppressing leakage of the lubricant from the clearance between the fixing member and the heating member at the lateral end portions of the fixing member in the axial direction of the fixing member.

In the fixing device 140 according to the above-described exemplary embodiments, the pressing roller 6 is used as a pressing member. Alternatively, a pressing belt, a pressing pad, or a pressing plate may be used as a pressing member to provide effects equivalent to the effects provided by the pressing roller 6.

Further, the fixing belt 31 is used as a fixing member. Alternatively, an endless fixing film may be used as a fixing member.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device for fixing a toner image on a recording medium, comprising:

a flexible endless belt-shaped fixing member to rotate in a predetermined direction of rotation, foamed into a loop;

a heating member provided inside the loop formed by the fixing member and facing an inner circumferential surface of the fixing member to heat the fixing member;

a nip formation member provided inside the loop formed by the fixing member and supported by the heating member, with a central convex portion of increased thickness provided at a center of the nip formation member in an axial direction of the fixing member and protruding toward the heating member; and a pressing member pressed against the nip formation member via the fixing member to form a fixing nip between the fixing member and the pressing member through which the recording medium bearing the toner image passes, the heating member having a tapered shape corresponding to the convex portion of the nip formation member, in which the heating member is tapered from lateral ends of increased diameter toward a center of reduced diameter of the heating member in the axial direction of the fixing member.

2. The fixing device according to claim 1, wherein the heating member is made of a cylindrical thin sheet metal, and comprises:

a center portion provided at the center of the heating member in the axial direction of the fixing member; and lateral end portions provided at the lateral ends of the heating member in the axial direction of the fixing member, and wherein a diameter of the heating member decreases from the lateral end portions thereof toward the center portion thereof.

3. The fixing device according to claim 2, wherein the convex portion of the nip formation member has a height sufficient to offset bending of the nip formation member caused by pressure applied by the pressing member to the nip formation member, and a difference between a diameter of the lateral end portions of the heating member and a diameter of the center portion of the heating member is equivalent to the height of the convex portion of the nip formation member to provide a substantially uniform clearance between the inner circumferential surface of the fixing member and an outer circumferential surface of the heating member in the axial direction of the fixing member.

4. The fixing device according to claim 2, wherein the cylindrical thin sheet metal of the heating member is elastically deformable to assume the tapered shape in which the lateral end portions of the heating member have a diameter greater than a diameter of the center portion of the heating member.

5. The fixing device according to claim 1, further comprising a support member provided inside the loop formed by the fixing member to support the heating member, the support member comprising a groove extending in the axial direction of the fixing member and having a tapered shape in which lateral end portions of the groove in the axial direction of the fixing member have a diameter greater than a diameter of a center portion of the groove in the axial direction of the fixing member, wherein the heating member comprises a concave portion facing the fixing nip and housing the nip formation member, the concave portion inserted into the groove of the support member.

6. The fixing device according to claim 1, further comprising a flange provided at the lateral end of the heating member in the axial direction of the fixing member and comprising a tapered portion inserted into the heating member to maintain the tapered shape of the heating member.

7. An image forming apparatus comprising the fixing device according to claim 1.

* * * * *